US012402684B1

(12) United States Patent
Lai et al.

(10) Patent No.: US 12,402,684 B1
(45) Date of Patent: Sep. 2, 2025

(54) FLAT ARCH CORRECTION TRAINING SHOE

(71) Applicant: Qinglin Lai, Jinjiang (CN)

(72) Inventors: Qinglin Lai, Jinjiang (CN); Xingwu Lan, Wuping County, Fujian Province (CN)

(73) Assignee: Qinglin Lai, Jinjiang (CN)

( * ) Notice: Subject to any disclaimer, the term of this patent is extended or adjusted under 35 U.S.C. 154(b) by 0 days.

(21) Appl. No.: 18/777,433

(22) Filed: Jul. 18, 2024

(51) Int. Cl.

| | |
|---|---|
| ***A43B 3/12*** | (2006.01) |
| ***A43B 3/00*** | (2022.01) |
| ***A43B 13/14*** | (2006.01) |
| ***A43B 23/02*** | (2006.01) |

(52) U.S. Cl.
CPC ..... *A43B 3/0036* (2013.01); *A43B 3/12* (2013.01); *A43B 3/128* (2013.01); *A43B 13/143* (2013.01); *A43B 13/148* (2013.01); *A43B 23/02* (2013.01)

(58) Field of Classification Search
CPC ..... A43B 3/12; A43B 3/128; A43B 7/1425; A43B 23/24; A43B 13/146; A43B 13/148; A43B 13/143
USPC ..... 36/11.5
See application file for complete search history.

(56) References Cited

U.S. PATENT DOCUMENTS 1,977,995 A * 10/1934 Morali ..... A43B 23/24 D10/111
2,097,930 A * 11/1937 Lustig ..... A43B 7/1445 36/180
2,159,054 A * 5/1939 Silver ..... A43B 7/1435 36/145
2,567,028 A * 9/1951 Rapisarda ..... A43B 7/1445 36/173
3,316,663 A * 5/1967 Neu ..... A43B 7/145 36/71
4,955,148 A * 9/1990 Padilla ..... A43B 7/145 36/43
5,384,974 A * 1/1995 Massimo ..... A43B 7/22 36/43
5,732,481 A * 3/1998 Farhad ..... A43B 7/1435 36/44
6,769,204 B1 * 8/2004 Phillips ..... A43B 3/0078 36/11.5
10,383,399 B1 * 8/2019 Trauner ..... A43B 13/12
2001/0039746 A1 * 11/2001 Seiter ..... A43B 7/144 36/43

(Continued)

*Primary Examiner* — Marie D Bays
(74) *Attorney, Agent, or Firm* — Hawaii Patent Services; Nathaniel K. Fedde; Kenton N. Fedde

(57) ABSTRACT

The invention pertains to a foot arch correction training shoe with a uniquely designed sole for enhanced arch training during walking. The sole comprises a front part, a middle part, and a rear part. The front part includes a transitional zoom and a toe support zoom, facilitating a point of force during walking for effective arch muscle training. The toe support zoom lies on a second horizontal surface, lower than the first horizontal surface on which the middle and rear parts of the sole rest. The transitional zoom features toe grip patterns for improved safety, and the shoe upper straddles the sole's sides for a secure fit. The shoe upper also includes decorative bumps for aesthetic appeal. The angle between the transitional zoom's inclined surface and the second horizontal surface ranges between 120° and 165°, ensuring optimal foot slope for both comfort and arch correction effectiveness.

8 Claims, 2 Drawing Sheets

(56) References Cited

U.S. PATENT DOCUMENTS

| | | | | |
|---|---|---|---|---|
| 2005/0039345 | A1* | 2/2005 | Jones | A43B 1/0027 36/7.1 R |
| 2006/0185197 | A1* | 8/2006 | Rhenter | A43B 13/12 36/43 |
| 2010/0115793 | A1* | 5/2010 | Kraisosky | A43B 23/24 36/102 |
| 2010/0242309 | A1* | 9/2010 | McCann | A43B 1/0027 36/43 |
| 2012/0174439 | A1* | 7/2012 | O'Connor | A43B 5/08 36/11.5 |
| 2012/0186109 | A1* | 7/2012 | Vanderbeek | A43B 3/242 36/136 |
| 2013/0067764 | A1* | 3/2013 | Riddle | A43B 7/1464 36/31 |
| 2013/0091620 | A1* | 4/2013 | Randolph | A43B 3/242 2/244 |
| 2013/0291406 | A1* | 11/2013 | Adair | A43C 15/162 36/126 |
| 2014/0352175 | A1* | 12/2014 | Katz | A43B 1/0072 36/100 |
| 2016/0302510 | A1* | 10/2016 | Brantley | A43B 1/0063 |
| 2020/0275738 | A1* | 9/2020 | Rhenter | A43B 17/00 |
| 2021/0052031 | A1* | 2/2021 | Shwarts | A43B 3/12 |
| 2021/0100312 | A1* | 4/2021 | Kim | A43B 7/24 |
| 2021/0361025 | A1* | 11/2021 | Rivera | A43B 3/107 |
| 2023/0218036 | A1* | 7/2023 | Goldoni | A43B 7/1435 36/180 |

* cited by examiner

FLAT ARCH CORRECTION TRAINING SHOE

TECHNICAL FIELD

The present invention generally relates to the field of athletic footwear, and more particularly to techniques for correcting and strengthening foot arches through training.

BACKGROUND

In the current state of the art, methods for maintaining the arch of the foot include elastic band training, heel lifting training, and other similar exercises. These techniques aim to strengthen the muscles of the foot arch, which is crucial to maintaining balance, ensuring correct gait, and preventing injuries. However, these methods have a number of disadvantages that limit their effectiveness.

Firstly, these existing methods are difficult to systematically and comprehensively train the toe muscles. This is due to the complex structure of the foot, which includes multiple muscle groups that need to be exercised in a balanced manner. Therefore, a training method that only focuses on certain muscle groups may not lead to optimal results.

Secondly, the training requires other aids such as hands, which are inconvenient to use. This inconvenience can be a barrier to regular training, as it adds an additional layer of complexity to the exercise routine. Furthermore, these methods cannot effectively strengthen the muscles of the sole of the foot, which are crucial for maintaining the shape and function of the arch.

Lastly, other arch products, like arch-supporting shoe pads, only provide support and do not substantially help the formation of the arch. While these products can provide temporary relief, they do not address the root cause of the problem, which is the weakness of the foot arch muscles.

It is therefore an objective of the present invention to provide a solution that can effectively train the muscles of the arch of the foot, without the need for additional aids or inconvenient exercise routines. This invention, compared to traditional ways of exercising the arch of the foot, turns our daily walking into a workout for the plantar fascia of the foot arch. There is no need to deliberately spend time exercising, and the arch of the foot does not feel tired. This is especially suitable for flat-footed children who are not very obedient in exercising their arches. Instead, by wearing these shoes in daily life, children can effectively exercise the arch. This structure is that of the sole, and can be applied to any shoes, providing a practical and effective solution to the problem.

SUMMARY

One aspect of the present invention relates to a foot arch correction training shoe. A foot arch correction training shoe may be understood as a specialized type of footwear that is designed to correct or improve the arch of the foot.

It may be provided that the foot arch correction training shoe comprises a sole with a front part, a middle part, and a rear part. The sole can be understood as the bottom part of the shoe that is in direct contact with the ground. The front part, middle part, and rear part refer to different sections of the sole, each providing a distinct function.

The front part of the sole comprises a transitional area and a toe support area. The transitional area can be understood as a region of the sole that facilitates a smooth transition from one part of the sole to another. The toe support area is a region of the sole designed to provide support to the toes.

The middle and the rear part of the sole lay on a first horizontal surface and provide support to the foot. Meanwhile, the front part of the sole is designed for toe depression, where the toe support area lays on a second horizontal surface, located below the first horizontal surface.

One advantage of this arrangement is that by setting up a sole support part and a toe recess part on the sole of the shoe, and connecting the sole support part and the toe recess part through an inclined transition surface, the toes can naturally buckle on the inclined transition surface to form a point of force when the user wears this arch correction training shoe for walking.

This natural buckling of the toes during daily walking can make the muscles of the arch get sufficient training. This inclined transition surface is a relatively gentle angle. When a person walks forward, the feet will push back, when our toes are inclined downwards, due to the automatic compensation of the muscles, the toe head and forepalm are the most effortless and effective points of force.

This innovative design of the shoe sole can more effectively push people forward, the plantar aponeurosis of the arch will reflexively exert force automatically, controlling the forepalm and toe head. This arrangement is effective in providing the stated technical advantages and could be apparent to a person skilled in the art from the claim element.

It may be provided that the inclined surface of the transitional area has toe grip patterns to prevent slipping. Toe grip patterns may be understood as physical designs or textures on the surface of the transitional area, which enhance friction and thus help prevent the wearer's toes from slipping when in contact with the surface. One advantage of this arrangement is that it increases the safety factor of the shoe, especially when the wearer is walking on slippery surfaces.

It may be provided that the grip pattern is carved on the sole and the number of patterns is 5. The grip patterns can be understood as physical indentations or raised areas on the sole, designed to increase traction. Having five such patterns provide a good balance between enhanced grip and maintaining the comfort of the shoe. This arrangement can effectively reduce the risk of slipping and falling, further improving the safety of the shoe.

It may be provided that a shoe upper straddles the sides of the sole along the width direction of the sole. The shoe upper can be understood as the top part of the shoe that covers the foot, providing protection and support. Having the shoe upper straddle the sides of the sole provides a stable and secure fit for the wearer, enhancing the effectiveness of the foot arch correction.

It may be provided that the shoe upper is set with several decorative bumps. These decorative bumps can be understood as raised elements on the shoe upper that add to the aesthetic appeal of the shoe. While this arrangement does not contribute directly to the technical functioning of the shoe, it enhances the overall visual appeal, potentially making the shoe more desirable to potential consumers.

It may be provided that the angle between the inclined surface of the transitional area and the second horizontal surface is 120°~165°. This specific angle range ensures an optimal slope for the wearer's foot, balancing comfort with the effectiveness of the arch correction. This arrangement allows for an optimal distribution of the wearer's weight, potentially contributing to better posture and gait.

BRIEF DESCRIPTION OF THE DRAWINGS

The accompanying drawings are included to provide a further understanding of the invention and are incorporated in and constitute a part of this specification, illustrate embodiments of the invention, and together with the description explain the principles of the invention.

DETAILED DESCRIPTION OF THE ILLUSTRATED EMBODIMENTS

Figure 1:
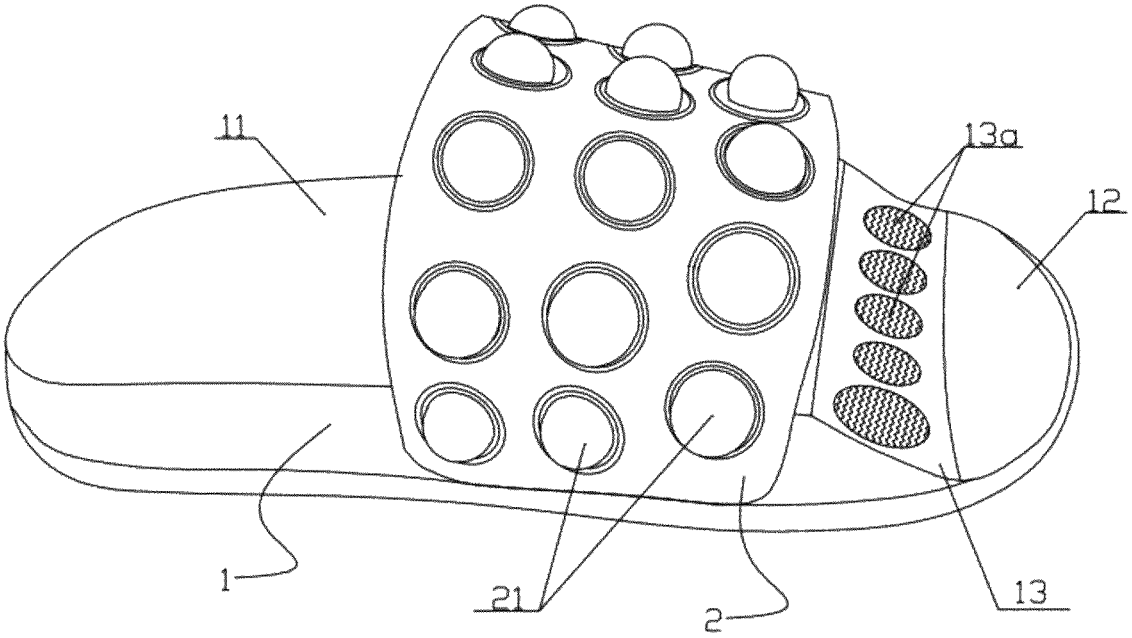
FIG. 1 shows a perspective view of a preferred embodiment of a arch correction training shoe.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying Figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Flatfoot, Talipes planus, Pes planus used interchangeably in this specification.

It needs to be clarified that, in the absence of conflict, the embodiments and features in the embodiments of this utility model can be combined with each other. In the description of this utility model, it should be understood that the terms "center", "longitudinal", "transverse", "up", "down", "front", "back", "left", "right", "vertical", "horizontal", "top", "bottom", "inside", "outside" etc. are based on the direction or positional relationship shown in the drawings. They are only used to facilitate the description of this utility model and simplify the description, and do not imply that the device or element referred to must have a specific orientation, construction, and operation. Therefore, they cannot be understood as a limitation of this utility model. In addition, terms "first", "second" are only used for descriptive purposes, and cannot be understood as indicating relative importance or implying the number of technical features indicated. Therefore, the features defined as "first", "second", etc. can explicitly or implicitly include one or more such features. In the description of this utility model, unless otherwise specified, the term "multiple" means two or more. In the description of this utility model, it should be noted that, unless otherwise specified and restricted, the terms "install", "connected", "connect" should be understood in a broad sense. For example, it can be a fixed connection, or a detachable connection, or a one-piece connection; it can be a mechanical connection, or an electrical connection; it can be a direct connection, or it can be indirectly connected through an intermediate medium; it can be a connection within two components. For those skilled in the art, they can understand the specific meaning of the above terms in this utility model based on specific situations. The utility model will be explained in detail below with reference to the drawings and in conjunction with the embodiments.

Figure 2:
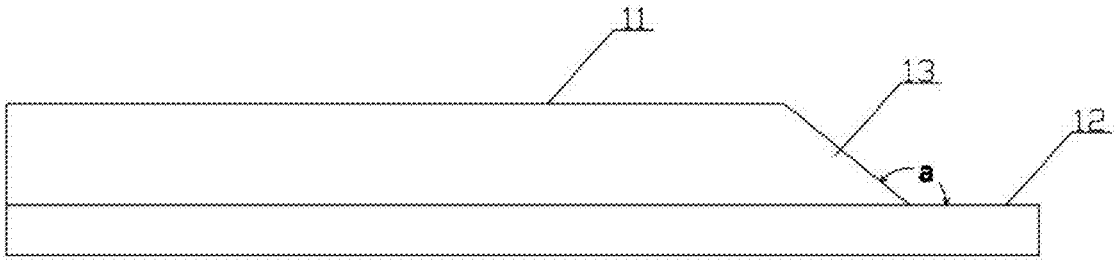
FIG. 2 shows a side perspective view of a arch correction training shoe of FIG. 1.

Embodiment As shown in FIGS. 1 and 2, a foot arch correction training shoe includes a sole 1, the middle and rear part of the sole 1 is a foot support part 11, and the foot support part 11 includes the middle and the rear part. Where, the middle and the rear part, which lays on a first horizontal surface. The front part of the sole 1 is a toe recessed part or called toe support area 12, and the toe support area lays on a second horizontal surface, and the second horizontal surface is located below the first horizontal surface; and the front edge of the foot support part 11 slopes downward towards the toe recessed part or called toe support area 12 to form a sloping transition surface or called transitional area 13; when wearing the training shoe for walking, the toes can buckle inwards on the sloping transition surface or called transitional area 13. Using this structure, by setting foot support part 11, toe recessed part or called toe support area 12 on the sole 1, and connecting the foot support part with the toe recessed part or called toe support area 12 through the sloping transition surface or called transitional area 13; that is, when the user wears the foot arch correction training shoe for walking, the user can naturally buckle the toes on the sloping transition surface to form a force point, and the muscles of the foot arch can be sufficiently trained when walking naturally, which is convenient and practical.

In one embodiment, the entire sole can be one-piece, or it can be made up of different parts, which are combined with glue or some fixed methods.

In this embodiment, the toe recessed part or called toe support area 12 extends along the width direction of the sole 1; one end of the toe recessed part or called toe support area 12 is connected to the sloping transition surface or called transitional area 13, and the other end of the toe recessed part or called toe support area 12 extends along the length direction of the sole 1. In this embodiment, a toe ground grip pattern 13*a* is provided on the sloping transition surface or called transitional area 13; the toe ground grip pattern 13*a* is integrated with the sole 1, and the number of toe ground grip patterns 13*a* is five. With this structure, by reasonably setting the number of toe ground grip patterns 13*a*, the grip of the toes on the sole 1 is greatly increased. In this embodiment, it also includes a shoe upper 2, the shoe upper 2 is bridged on both sides of the sole 1 in the width direction of the sole 1; the sloping transition surface or called transitional area 13 is located in front of the shoe upper 2. With this structure, it is conducive to wearing the foot arch correction training shoe. In this embodiment, several decorative protrusions 21 are provided on the outer surface of the shoe upper 2. With this structure, the decorative protrusions 21 are set to improve the aesthetics.

The heel and arch (include palm) of the foot are on the first horizontal surface. The toe part is on the second horizontal surface, The first horizontal surface is higher than the second horizontal surface. Moreover, the heel and arch (include palm) of the foot are touching the first horizontal surface, which support the entire heel and arch portion of the foot, there may be a protrusion at the arch area of foot but the first horizontal surface is not at the top of protrusion, it is at the base touch the most area of heel and arch and palm.

In this embodiment, the angle a between the sloping transition surface and the upper end face of the toe recessed part is 120°~165°, preferably 145°.

When the human foot wears the training shoe of this utility model, first put the foot through the shoe upper 2, then place the foot board on the foot support part 11. When walking, in order to make the training shoe fit better, the toes will naturally buckle downwards and bend onto the sloping transition surface or called transitional area 13 for foot arch training, at which time the foot arch can be lifted due to the downward bending of the toes, playing a role in training the foot arch. The above is only the best embodiment of this utility model, and it is not intended to limit this utility model. Any modifications, equivalent substitutions, and improvements made within the spirit and principle of this utility model should be included within the protection scope of this utility model.

The invention claimed is:

1. A foot arch correction training shoe comprising: a sole comprising a front part, a middle part, a rear part, shoe upper; wherein the front part comprises a transitional area and toe support area;

wherein, the middle and the rear part, which lays on a first horizontal surface; the middle and the rear part of the sole provide support to the foot and the front part of the sole is for toe depression; where the toe support area lays on a second horizontal surface, and the second horizontal surface is located below the first horizontal surface; and the transitional area has a inclined surface connects the first and the second horizontal surface, wherein an angle between the inclined surface and the surface of second horizontal is 120°~165°; and wherein the inclined surface has a toe grip pattern to prevent slippage.

2. The foot arch correction training shoe of claim 1, wherein the shoe upper straddles the sides of the sole along the width direction of the sole.

3. The foot arch correction training shoe of claim 1, wherein the inclined surface and the surface of second horizontal are flat.

4. The foot arch correction training shoe of claim 1, wherein the two grip pattern is carved on the sole.

5. The foot arch correction training shoe of claim 4, wherein the toe grip pattern comprises 5 toe grips.

6. The foot arch correction training shoe of claim 1, wherein the toe grip pattern comprises a pattern of physical indentations.

7. The foot arch correction training shoe of claim 6, wherein said angle is 145°.

8. The foot arch correction training shoe of claim 1, wherein said angle is 145°.

* * * * *